US006790089B2

(12) United States Patent
Wu

(10) Patent No.: US 6,790,089 B2
(45) Date of Patent: Sep. 14, 2004

(54) CABLE ASSEMBLY

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/418,706

(22) Filed: Apr. 18, 2003

(65) Prior Publication Data

US 2004/0077228 A1 Apr. 22, 2004

Related U.S. Application Data

(63) Continuation-in-part of application No. 10/278,520, filed on Oct. 22, 2002.

(51) Int. Cl.[7] ..... H01R 13/648
(52) U.S. Cl. ..... 439/608; 439/579
(58) Field of Search ..... 439/608, 579, 439/108, 101, 79, 76.1, 701, 610

(56) References Cited

U.S. PATENT DOCUMENTS 5,108,313 A 4/1992 Adams
5,421,746 A 6/1995 David
5,924,899 A 7/1999 Paagman
5,993,259 A * 11/1999 Stokoe et al. ..... 439/608
6,083,047 A * 7/2000 Paagman ..... 439/608
6,102,747 A 8/2000 Paagman
6,146,202 A * 11/2000 Ramey et al. ..... 439/608
6,217,364 B1 4/2001 Miskin et al.
6,238,245 B1 * 5/2001 Stokoe et al. ..... 439/608
6,273,762 B1 * 8/2001 Regnier ..... 439/701
6,299,483 B1 * 10/2001 Cohen et al. ..... 439/608
6,380,485 B1 * 4/2002 Beaman et al. ..... 174/88 R
6,428,344 B1 * 8/2002 Reed ..... 439/455
6,468,110 B2 * 10/2002 Fujino et al. ..... 439/610
6,471,547 B1 * 10/2002 Venaleck et al. ..... 439/608

* cited by examiner

*Primary Examiner*—Gary Paumen
(74) *Attorney, Agent, or Firm*—Wei Te Chung

(57) ABSTRACT

A cable assembly (1) for engaging a complementary connector includes an insulating housing (10), a number of circuit modules (20) received in the housing, and a two-piece cover (30) cooperating with the housing for retaining the circuit modules. Each circuit module includes a circuit board (22) accommodated in the housing, a number of cables (23) mechanically and electrically connecting with the circuit board, and an overmolded casing (25) encasing therein a rear edge portion of the circuit board and front portions of the cables. The overmolded casing includes a number of protrusions (253) protruded from opposite faces (250, 251) thereof and a number of recesses (254) defined on opposite faces for receiving corresponding protrusions on the overmolded casing of an adjacent circuit module.

3 Claims, 11 Drawing Sheets

CABLE ASSEMBLY

CROSS-REFERENCE TO RELATED APPLICATIONS

This patent application is a continuation-in-part of U.S. patent application Ser. No. 10/278,520, filed on Oct. 22, 2002, entitled "ELECTRICAL CABLE CONNECTOR"; and is related to U.S. patent application Ser. No. 10/316,547, entitled "CABLE ASSEMBLY", filed on Dec. 10, 2002, both assigned to the same assignee with this patent application.

BACKGROUND OF THE INVENTION

1. Field of the Invention

The present invention generally relates to a cable assembly, and particularly to a cable assembly having a plurality of circuit boards for high speed signal transmission.

2. Description of Related Arts

With the development of communication and computer technology, high density electrical connectors are desired to construct a plurality of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combine to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. No. 5,924,899 (the '899 patent) and U.S. Pat. No. 6,102,747 (the '747 patent), both issued to Paagman, each disclose a cable assembly. Referring to FIGS. 4*a*–4*c* and 5*a*–5*c* of the '899/'747 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bond the cables together, thereby increasing the cost of the production.

U.S. Pat. No. 5,421,746, filed on Sep. 13, 1993 and issued to David, discloses a modular connector having a plurality of overmolded connectors encased in an outer shell. Each overmolded connector includes a circuit board overmolded in a casing. The circuit board provides an interface between electrical wires and contact surfaces. In order to ascertain a predetermined position and orientation of electrical connections in the modular connector, a plurality of keys are disposed in the modular connector. Obviously, the employments of the keys complex the manufacturing and the assembling of the product, and unavoidably increase the cost of the production.

Hence, an improved cable assembly is highly desired to overcome the disadvantages of the related arts.

BRIEF SUMMARY OF THE INVENTION

Accordingly, it is an object of the present invention to provide a cable assembly having a plurality of circuit boards reliably retained in a housing thereof.

It is another object of the present invention to provide a cable assembly having overmolded means for substantially resisting a pulling force exerted on a cable thereof to thereby maintain a reliable electrical connection between the cable and a corresponding circuit board thereof.

It is still another object of the present invention to provide a cable assembly having a grounding plate for reducing crosstalk between adjacent cables thereof.

In order to achieve the above-mentioned objects, a cable assembly in accordance with the present invention for engaging a complementary connector, comprises an insulating housing, a plurality of circuit modules received in the housing, and a two-piece cover cooperating with the housing for retaining the circuit modules. Each circuit module includes a circuit board accommodated in the housing, a number of cables mechanically and electrically connecting with the circuit board, and an overmolded casing encasing therein a rear edge portion of the circuit board and front portions of the cables. The overmolded casing comprises a plurality of protrusions protruded from opposite faces thereof and a plurality of recesses defined on opposite faces for receiving corresponding protrusions on the overmolded casing of an adjacent circuit module.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
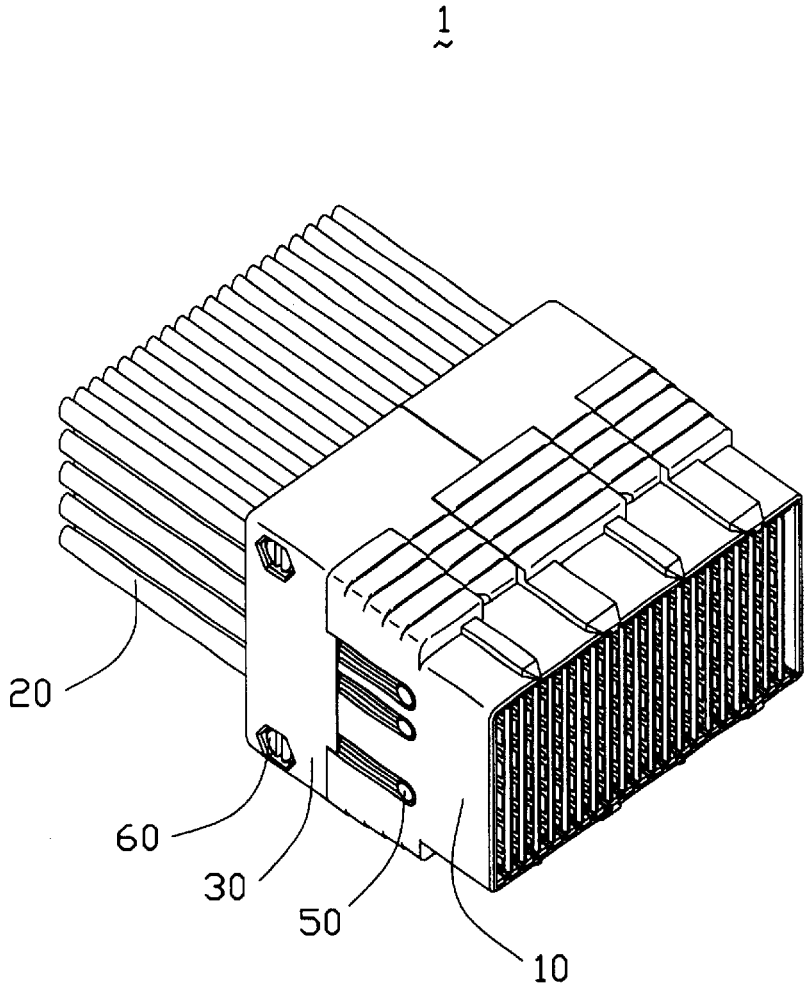
FIG. 1 is a perspective view of a cable assembly in accordance with the present invention.
Figure 2:
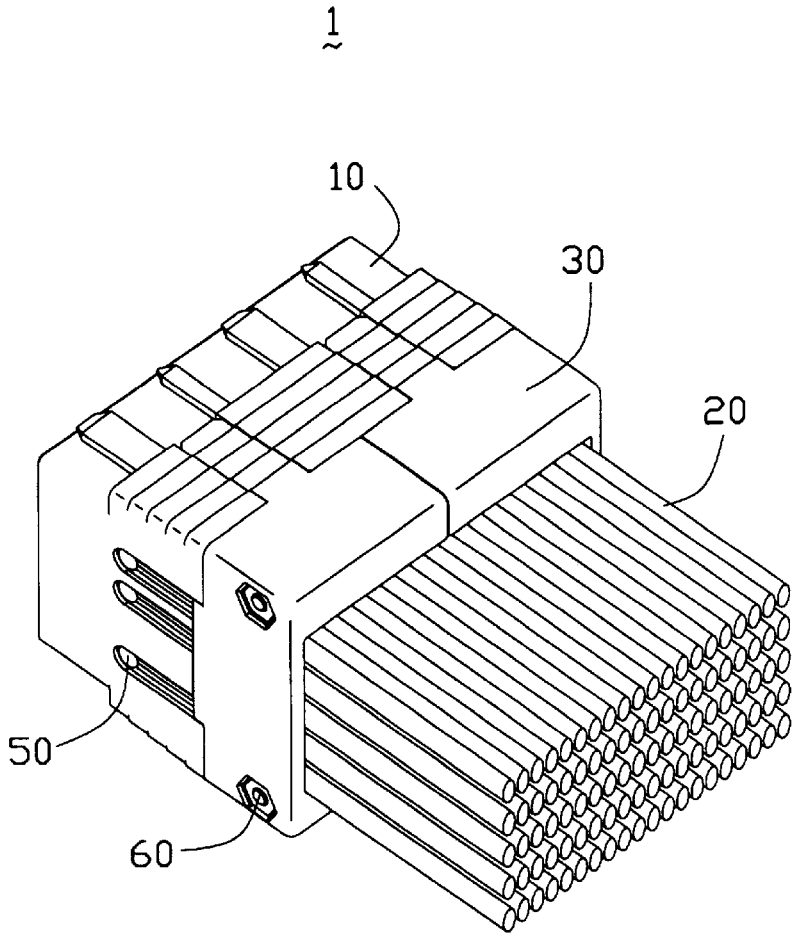
FIG. 2 is another perspective view of the cable assembly.

Reference will now be made to the drawing figures to describe the present invention in detail.

With reference to FIGS. 1–4, a cable assembly 1 in accordance with the present invention comprises a front insulating housing 10, a plurality of circuit modules 20 received in the front insulating housing 10, a two-piece rear cover 30 together with the front insulating housing 10 for retaining the circuit modules 20.

Figure 3:
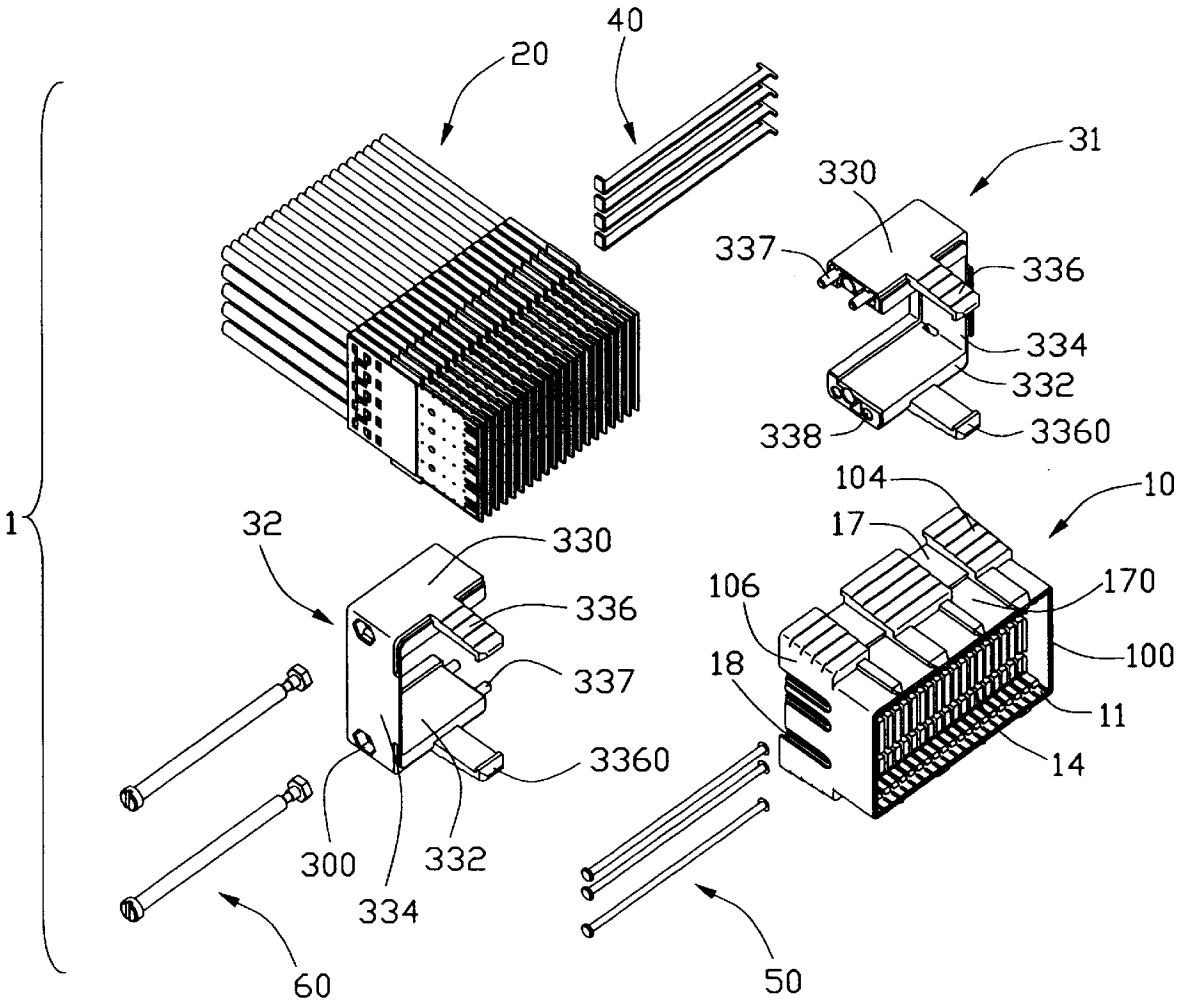
FIG. 3 is an exploded view of the cable assembly.
Figure 4:
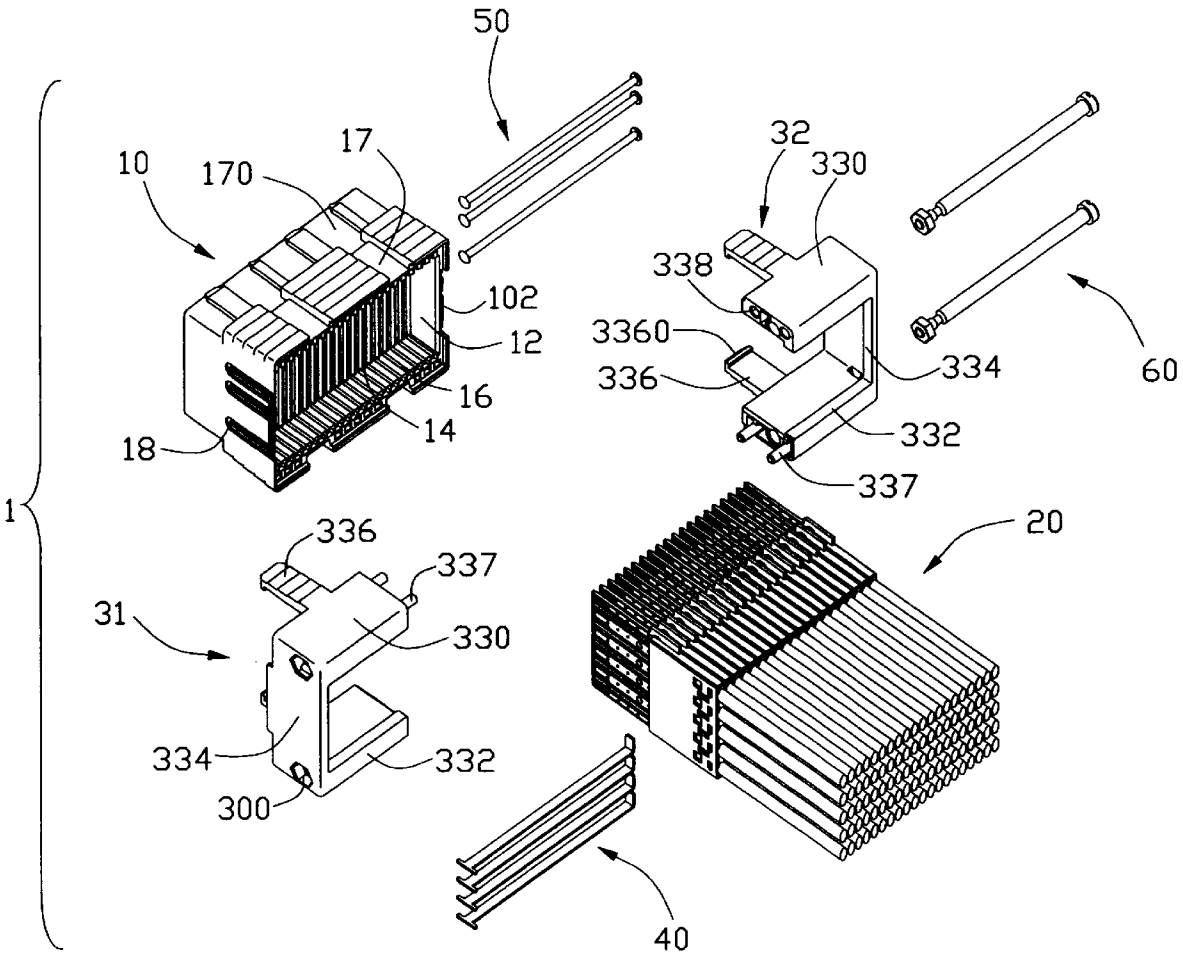
FIG. 4 is another exploded view of the cable assembly.
Figure 5:
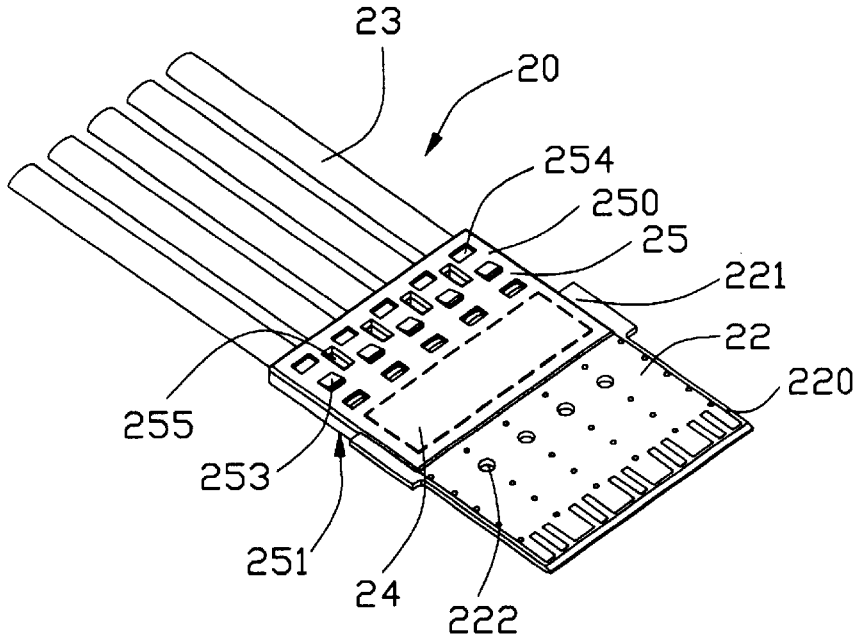
FIG. 5 is a perspective view of a circuit module.
Figure 6:
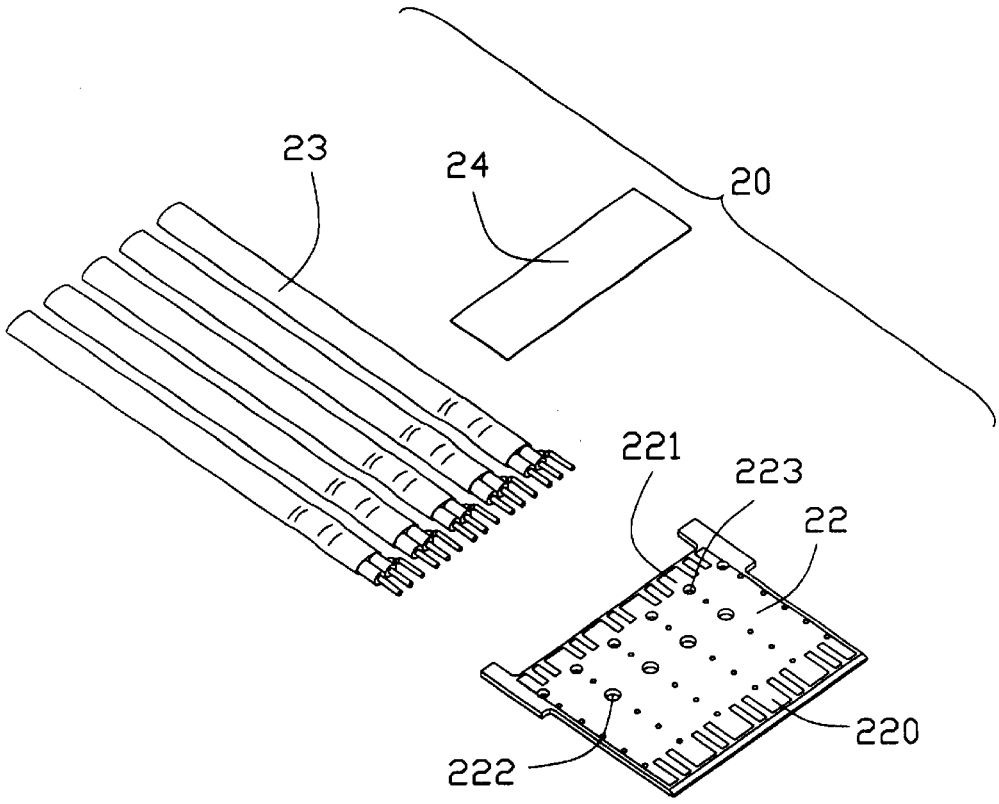
FIG. 6 is an exploded, perspective view of the circuit module shown in FIG. 5 before overmolding a casing thereon.
Figure 7:
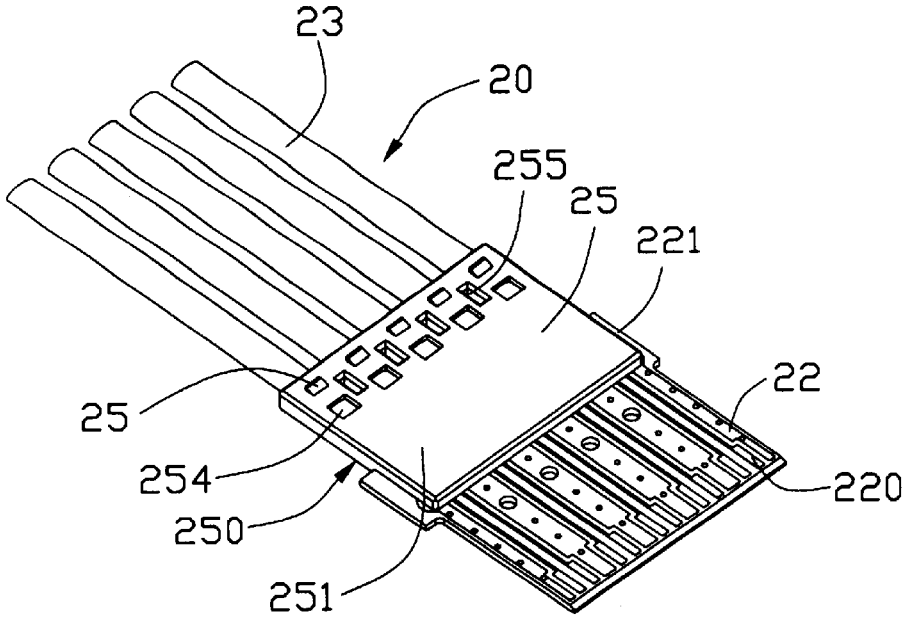
FIG. 7 is another perspective view of the circuit module.
Figure 8:
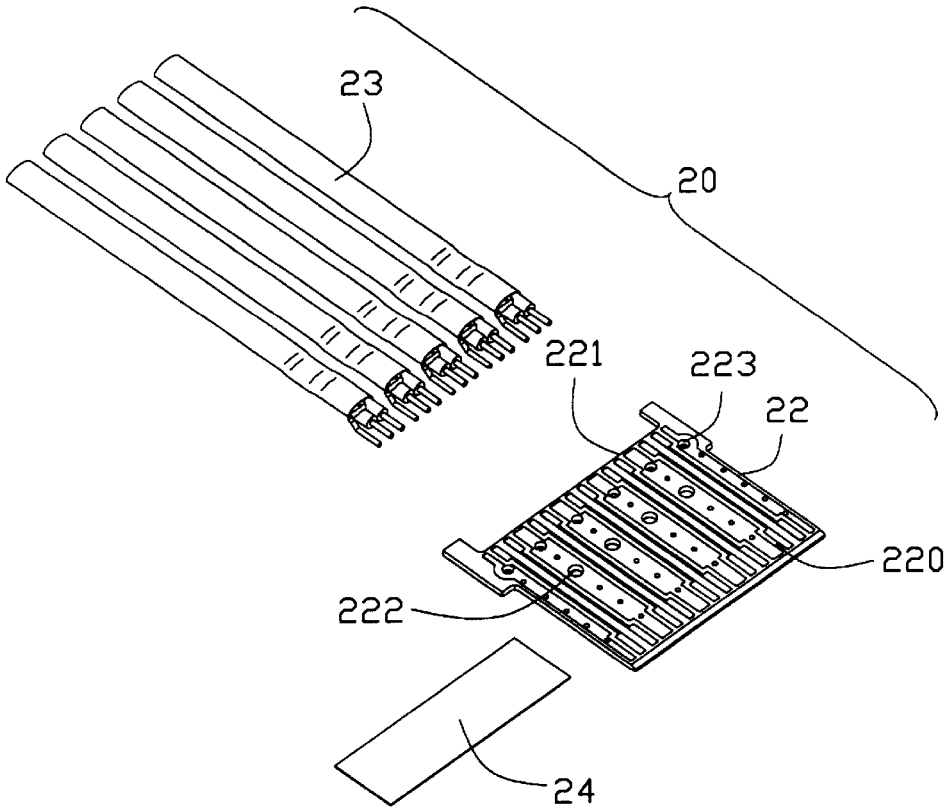
FIG. 8 is an exploded, perspective view of the circuit module shown in FIG. 7 before overmolding the casing thereon.

Referring to FIGS. 3 and 4, the front housing 10 is generally in a rectangular shape. The housing 10 has a front mating port 11 in a front mating face 100 which faces a complementary connector (not shown) and a rear chamber 12 in a rear face 102. The housing 10 defines a plurality of parallel channels 14 extending in a front-to-back direction communicating with the front mating port 11 and the rear chamber 12 and a plurality of grooves 16 which are aligned with the channels 14. The housing 10 further defines a plurality of recesses 17 respectively in a top face 104 and a bottom face (not labeled) and a plurality of depressions 170 recessed downwardly from the corresponding recesses 17. A cavity 18 is defined through opposite side faces 106 of the housing 10 in a direction substantially perpendicular to the extending direction of the channels 14.

Continuing to FIGS. 3 and 4, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 onto the housing 10 over the circuit modules 20. Of course, the first and the second halves 31, 32 can be integrally formed with each other before assembling to the housing 10, if desired.

The circuit modules 20 are identical with each other in structure thereof and an exemplary one is shown in FIGS. 5–8. Each circuit module 20 comprises a circuit board 22 and a plurality of cables 23 electrically and mechanically connecting with the circuit board 22. The circuit board 22 includes a dielectric substrate made of conventional circuit board substrate material, a plurality of conductive signal traces (not labeled) on one side of the substrate for providing electrical paths through the cable assembly 1 and a plurality of grounding traces (not labeled) on both sides of the substrate for grounding purpose. The cables 23 of each circuit module 20 are arranged in a common plane and have conductive cores (not labeled) soldered to the traces on the circuit board 22. Each circuit board 22 comprises a front edge portion 220 provided for engaging with the complementary mating connector and a rear edge portion 221 to which the cables 23 are mechanically connected.

Figure 9:
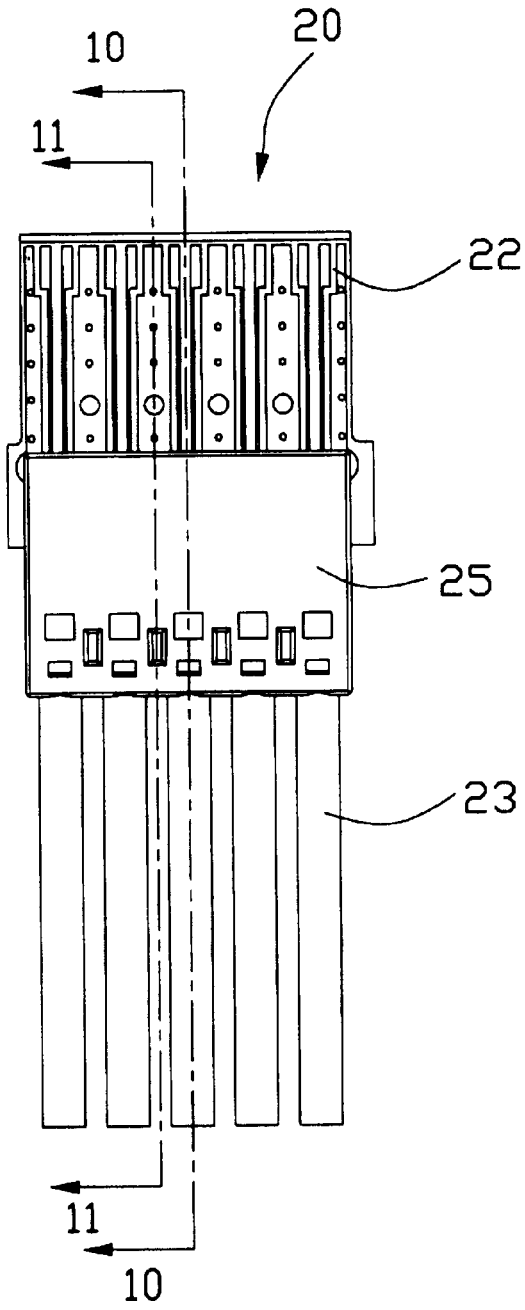
FIG. 9 is a top plan view of the circuit module.
Figure 10:
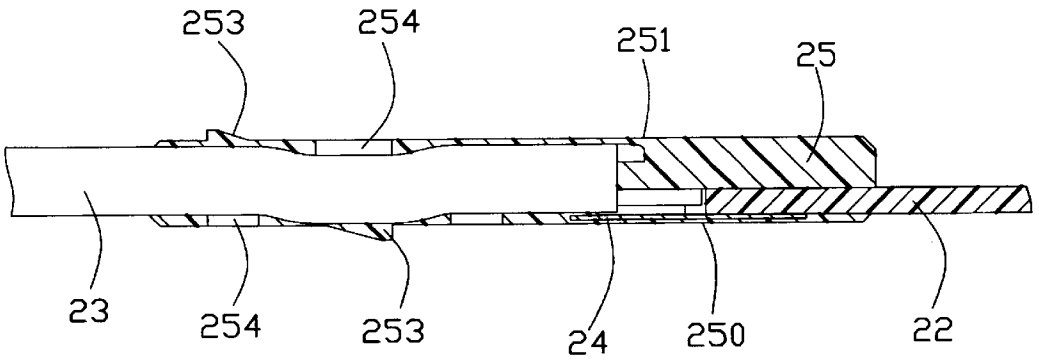
FIG. 10 is a partially enlarged, cross-sectional view of the circuit module taken along section line 10—10 in FIG. 9.
Figure 11:
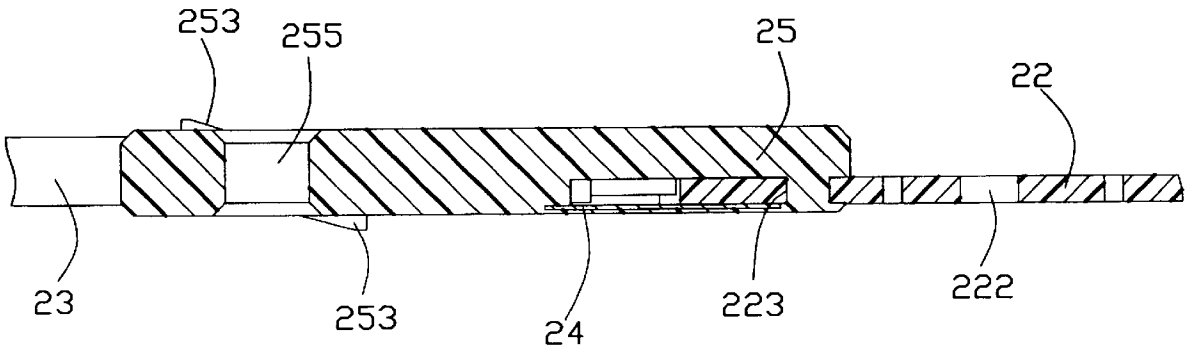
FIG. 11 is a partially enlarged, cross-sectional view of the circuit module taken along section line 11—11 in FIG. 9.

With reference to FIGS. 5–8 in conjunction with FIGS. 9–11, the circuit module 20 also comprises a grounding plate 24 and a casing 25. The casing 25 is overmolded onto the rear edge portion 221 of the circuit board 22, and encases therein front portions of the corresponding cables 23 and the grounding plate 24. The casing 25 includes opposite first and second faces 250, 251, and a plurality of protrusions 253 protruded from opposite first and second faces 250, 251, respectively. The casing 25 also defines a plurality of recesses 254 on opposite first and second faces 250, 251, each being defined in correspondence with a protrusion 253 on opposite face. A plurality of through-holes 255 are defined through the opposite faces 250, 251 of the casing 25. It should be noted here that the protrusions 253 on the opposite faces 250, 251 of the casing 25 slope along opposite directions to thereby retain the circuit module 20 in its original position with respect to adjacent circuit modules 20.

Figure 12:
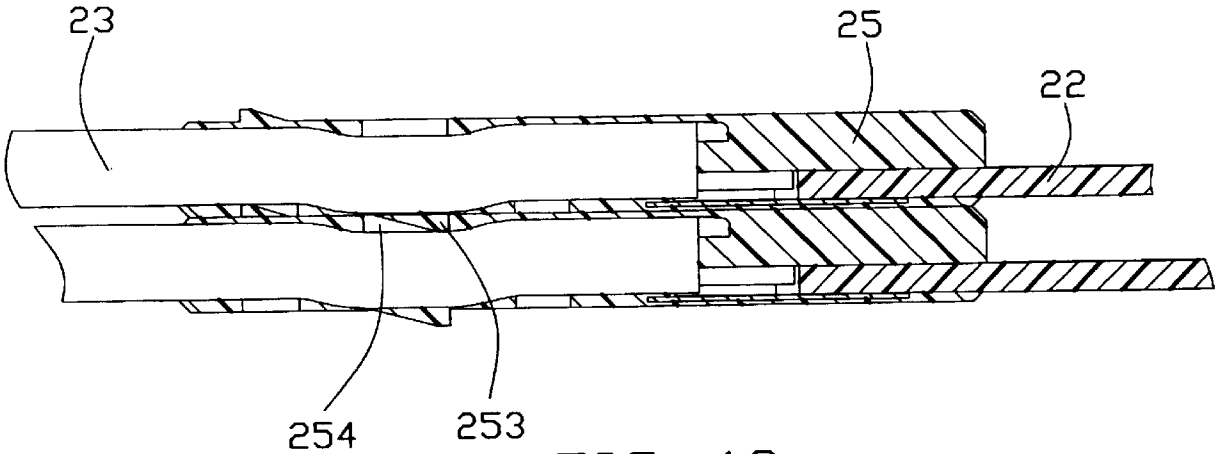
FIG. 12 is a view similar to FIG. 10 while showing two circuit modules arranged side by side.
Figure 13:
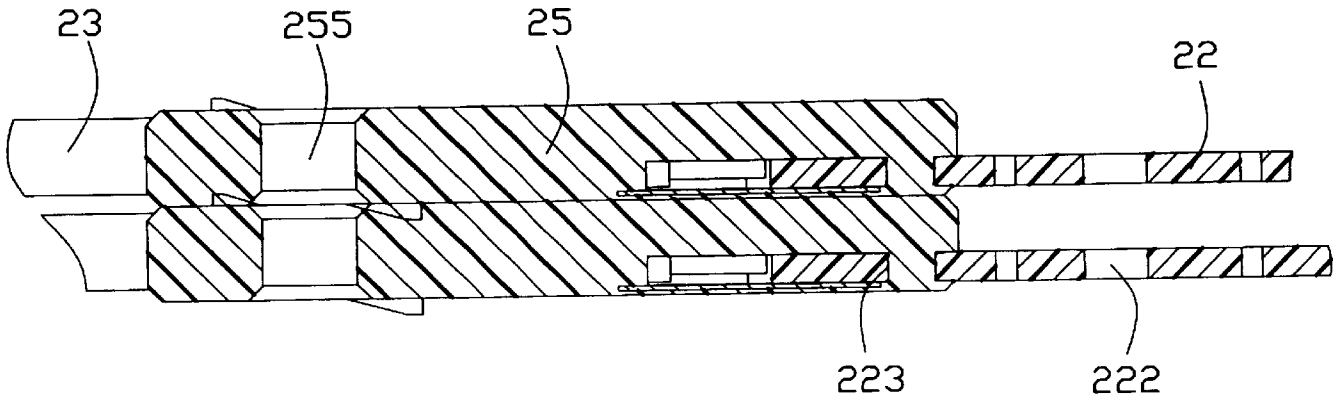
FIG. 13 is a view similar to FIG. 11 while showing two circuit modules arranged side by side.

Particularly referring to FIGS. 12 and 13, two adjacent assembled circuit modules 20 are shown in detail. The protrusions 253 on one face 250/251 of a circuit module 20 are received in corresponding recesses 254 defined on the casing 25 of an adjacent circuit module 20 so that the two circuit modules 20 are reliably attached with each other. Moreover, each circuit board 22 defines a plurality of holes 223 (FIGS. 6 and 8) therethrough, which will fill with material during overmolding the casing 25 onto the circuit board 22.

Referring back to FIGS. 3–4 in conjunction with FIGS. 5–10, in assembly, the circuit modules 20 are inserted into the channels 14 of the housing 10 from the rear face 102 until the circuit boards 22 arrive at a position where front edge portions 220 of the circuit boards 22 are substantially adjacent to the front mating face 100 of the housing 10 and top and bottom ends of the circuit boards 22 are substantially retained in the grooves 16. First fastening elements 40 are inserted into the through-holes 255 of the casings 25 for locking the circuit modules 20 together for strain relief purpose. A second fastening element 50 is inserted into holes 222 defined in the circuit boards 22 through the cavity 18 of the housing 10. The second fastening element 50 is further fastened to the housing 10 for keeping the circuit modules 20 in their original positions rather than be pushed back when the cable assembly 1 mates with the complementary connector, thereby stably retaining the circuit modules 20 in the housing 10.

The first and second halves 31, 32 of the cover 30 are assembled to the housing 10 with the projections 3360 of the latches 336 mechanically engage the depressions 170 of the recesses 17. At the same time, the first and second halves 31, 32 are connected by an interference engagement between the dowel pins 337 and the corresponding recesses 338. A third fastening element 60 is inserted into the bore 300 of the cover 30 for retaining the circuit modules 20 in the cover 30.

It is noted that since the circuit modules 20 are stably retained by the front housing 10 and the rear cover 30 via the second and third fastening elements 50, 60, a reliable electrical engagement is ensured between the cable assembly 1 and the complementary connector. It is also noted that the cables 23 are substantially encased in the overmolded casings 25, more importantly, the overmolded casings 25 are locked together via the first fastening elements 40, whereby a pulling force exerted on the cables 23 can be substantially released. Moreover, each of the cables 23 comprises a light-curving portion (not labeled) formed within the casing 25 to increase the retention force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly comprising:

an insulating housing defining a plurality of channels; and a plurality of circuit modules juxtaposed in the housing, each circuit module comprising a circuit board received in a corresponding channel of the housing, a plurality of cables connecting to the circuit board, and a overmolded casing substantially encasing a connection area of the circuit board and corresponding cables, the casing comprising opposite first and second faces, at least one protrusion protruded from the first face, and at least one recess defined in the second face;

wherein the casing has at least one protrusion formed on the second race adjacent to the at least one recess and at least one recess defined in the first face adjacent to the at least one protrusion, the protrusions on the opposite first and second faces sloping along opposite directions;

wherein the circuit module comprises a grounding plate disposed within the casing;

further comprising a fastening means, and wherein the channels of the housing extend in a first direction of the housing and the casing of each circuit module defines a through-hole extending in a second direction substantially perpendicular to the first direction of the housing for insertion of the fastening means;

wherein each of the cables comprises a light-curving portion formed within the casing.

2. A cable assembly comprising:

an insulating housing comprising a plurality of channels and a cavity extending along a direction perpendicular to the channels;

a plurality of circuit modules each comprising a circuit board being retained in a corresponding channel of the housing and defining therethrough an aperture aligned with the cavity of the housing, a plurality of cables having front portions electrically connecting to a rear edge portion of the circuit board, and a casing disposed outside the circuit board and the cables, the casing defining a hole therethrough;

a cover comprising first and second halves jointed together and being attached to the housing; and first and second fastening means respectively inserted into the holes of the casings and the apertures of the circuit boards through the cavity of the housing;

wherein the casing comprises opposite first and second faces and a plurality of protrusions protruding from the first and second faces, respectively;

wherein the protrusions on the opposite first and second faces slope along opposite directions;

wherein the casing comprises a plurality of recesses respectively defined on the first and second faces thereof, each recess correspondingly receiving a protrusion of an adjacent circuit module;

wherein each circuit board defines at least one hole therethrough, the at least one hole being filled with material during overmolding the casing.

3. A cable assembly comprising:

an insulating housing;

a plurality of circuit boards juxtaposed in the insulating housing, each circuit board extending along a lengthwise direction while the circuit board side by side arranged with one another along a lateral direction, each circuit board having a rear edge portion;

a plurality of sets of cables being arranged in a matrix manner on a lateral plane, each set being commonly mounted on the rear edge portion of each of the circuit boards; and a plurality of casings being respectively overmolded onto the individual circuit boards and encasing therein the rear edge portion of the circuit board and corresponding cables;

further comprising a fastening means, and wherein each casing defines a through-hole for insertion of the fastening means;

wherein each of said casings defines openings and protrusions on two opposite surfaces so as to allow said casings side by side stacked to each other under a condition that the protrusions of one casing are received in the corresponding openings of the adjacent casing;

wherein in each of the casings portions of the cables around the corresponding protrusions are deflected toward the corresponding protrusions in an offset manner so as to increase securement between the casing and the cables and result in better strain relief of the cables;

wherein each of said printed circuit boards initially defines a plurality of through holes while later filled with the corresponding overmolded casing so as to increase retention between the printed circuit board and the casing in the lengthwise direction.

* * * * *